US007296759B2

(12) United States Patent
Alexander et al.

(10) Patent No.: US 7,296,759 B2
(45) Date of Patent: Nov. 20, 2007

(54) RATCHETING RETAINING RING

(75) Inventors: Kevin L. Alexander, Brownsburg, IN (US); Michael C. Rodgers, Montpelier, OH (US)

(73) Assignee: Illinois Tool Works Inc., Glenview, IL (US)

( * ) Notice: Subject to any disclaimer, the term of this patent is extended or adjusted under 35 U.S.C. 154(b) by 370 days.

(21) Appl. No.: 10/993,817

(22) Filed: Nov. 19, 2004

(65) Prior Publication Data

US 2006/0108436 A1 May 25, 2006

(51) Int. Cl.
*B05B 1/28* (2006.01)

(52) U.S. Cl. ..... 239/296; 239/290; 239/417.3; 239/417.5; 239/424; 239/526; 239/600; 239/704; 239/707; 239/708

(58) Field of Classification Search ..... 239/290, 239/296, 416.5, 423, 417.3, 424, 417.5, 422, 239/428, 433, 525, 526, 600, 690, 704–708; 411/1, 6, 7, 500; 285/18
See application file for complete search history.

(56) References Cited

U.S. PATENT DOCUMENTS 3,940,061 A 2/1976 Gimple et al.
3,964,683 A 6/1976 Gimple
3,990,609 A 11/1976 Grant
4,001,935 A 1/1977 Krohn et al.
4,002,777 A 1/1977 Juvinall et al.
4,030,857 A 6/1977 Smith, Jr.
4,037,561 A 7/1977 LaFave et al.
4,081,904 A 4/1978 Krohn et al.
4,105,164 A 8/1978 Lau et al.
4,114,564 A 9/1978 Probst
4,116,364 A 9/1978 Culbertson et al.
4,133,483 A 1/1979 Henderson
D252,097 S 6/1979 Probst et al.
4,165,022 A 8/1979 Bentley et al.
4,169,545 A 10/1979 Decker
4,174,070 A 11/1979 Lau et al.
4,174,071 A 11/1979 Lau et al.
4,214,709 A 7/1980 Scull et al.
4,248,386 A 2/1981 Morle
4,294,411 A * 10/1981 Hastings et al. ..... 239/707
4,331,298 A 5/1982 Bentley et al.
RE30,968 E 6/1982 Grant
4,361,283 A 11/1982 Hetherington et al.
D270,179 S 8/1983 Grime
D270,180 S 8/1983 Grime (Continued)

*Primary Examiner*—Steven J. Ganey
(74) *Attorney, Agent, or Firm*—Barnes & Thornburg LLP

(57) ABSTRACT

A retaining ring for a coating material dispenser including a nozzle for the discharge of coating material and a cap having a plurality of orifices arrayed in a spatial orientation with respect to the nozzle to supply a flow of gas or a mixture of gases to aid in dispensing of the coating material from the nozzle. The retaining ring is adapted for retaining the cap on the coating material dispenser with the plurality of orifices in the spatial orientation. The retaining ring includes first and second members. The second member is adapted for coupling to the coating material dispenser. The first member includes a first torque limiting driving member. The second member includes a second torque limiting driven member for engaging the first torque limiting driving member to limit the torque which the second member can apply to the coating material dispenser in response to manipulation of the first member.

21 Claims, 10 Drawing Sheets

U.S. PATENT DOCUMENTS

D270,367 S 8/1983 Grime
D270,368 S 8/1983 Grime
4,401,268 A 8/1983 Pompomi, Jr.
4,433,812 A 2/1984 Grime
4,437,614 A 3/1984 Garcowski
4,453,670 A 6/1984 Sirovy
4,483,483 A 11/1984 Grime
4,513,913 A 4/1985 Smith
4,529,131 A 7/1985 Rutz
4,537,357 A 8/1985 Culbertson et al.
4,606,501 A 8/1986 Bate et al.
4,613,082 A 9/1986 Gimple et al.
D287,266 S 12/1986 Knetl et al.
4,702,420 A 10/1987 Rath
4,747,546 A 5/1988 Talacko
4,759,502 A 7/1988 Pomponi, Jr. et al.
4,760,962 A 8/1988 Wheeler
4,770,117 A 9/1988 Hetherington et al.
4,844,342 A 7/1989 Foley
D303,139 S 8/1989 Morgan
D305,057 S 12/1989 Morgan
D305,452 S 1/1990 Morgan
D305,453 S 1/1990 Morgan
4,911,367 A 3/1990 Lasley
4,917,300 A * 4/1990 Gloviak et al. ..... 239/290
4,927,079 A 5/1990 Smith
4,934,603 A 6/1990 Lasley
4,934,607 A 6/1990 Lasley
4,993,645 A 2/1991 Buschor
5,022,590 A 6/1991 Buschor
D318,712 S 7/1991 Buschor
5,054,687 A 10/1991 Burns et al.
5,064,119 A 11/1991 Mellette
5,074,466 A 12/1991 Santiago
5,090,623 A 2/1992 Burns et al.
D325,241 S 4/1992 Buschor
5,118,080 A 6/1992 Hartmann
5,119,992 A 6/1992 Grime
5,178,330 A 1/1993 Rodgers
5,180,104 A 1/1993 Mellette
5,209,365 A 5/1993 Wood
5,209,405 A 5/1993 Robinson et al.
5,236,129 A 8/1993 Grime et al.
5,284,299 A 2/1994 Medlock
5,284,301 A 2/1994 Kieffer
5,289,974 A 3/1994 Grime et al.
5,299,740 A 4/1994 Bert
5,303,865 A 4/1994 Bert
5,330,108 A 7/1994 Grime et al.
5,332,156 A 7/1994 Wheeler
5,332,159 A 7/1994 Grime et al.
D349,559 S 8/1994 Vanderhoef et al.
5,351,887 A 10/1994 Heterington et al.
5,395,054 A 3/1995 Wheeler
5,400,971 A 3/1995 Maugans et al.
5,553,788 A 9/1996 Del Gaone et al.
5,582,350 A 12/1996 Kosmyna et al.
5,618,001 A 4/1997 Del Gaone et al.
5,639,027 A 6/1997 Fritz
RE35,769 E 4/1998 Grime et al.
5,803,313 A 9/1998 Flatt et al.
5,829,679 A 11/1998 Strong
5,836,517 A 11/1998 Burns et al.
RE36,378 E 11/1999 Mellette
6,036,109 A * 3/2000 DeYoung ..... 239/600
6,179,148 B1 1/2001 Harris
6,179,223 B1 1/2001 Sherman et al.
6,189,809 B1 2/2001 Schwebemeyer
6,276,616 B1 8/2001 Jenkins
6,367,641 B1 4/2002 Garcia et al.
6,402,058 B2 6/2002 Kaneko et al.
6,460,787 B1 10/2002 Hartle et al.
6,572,029 B1 6/2003 Holt
6,669,112 B2 12/2003 Reetz, III et al.
6,698,670 B1 3/2004 Gosis et al.
6,712,292 B1 3/2004 Gosis et al.
6,971,590 B2 * 12/2005 Blette et al. ..... 239/424
7,032,839 B2 * 4/2006 Blette et al. ..... 239/290
7,201,336 B2 * 4/2007 Blette et al. ..... 239/525
2003/0006322 A1 1/2003 Hartle et al.

* cited by examiner

RATCHETING RETAINING RING

FIELD OF THE INVENTION

This invention relates to threaded retainers. It is disclosed in the context of threaded retainers for retaining air caps, nozzles and the like on the front ends of coating dispensing devices (hereinafter sometimes spray guns). However, it is believed to be useful in other applications as well.

BACKGROUND OF THE INVENTION

Various types of manual and automatic spray guns are known. There are, for example, the manual spray guns illustrated and described in the following listed U.S. Patents and published applications: 2003/0006322; U.S. Pat. Nos. 6,712,292; 6,698,670; 6,669,112; 6,572,029; 6,460,787; 6,402,058; RE36,378; 6,276,616; 6,189,809; 6,179,223; 5,836,517; 5,829,679; 5,803,313; RE35,769; 5,639,027; 5,618,001; 5,582,350; 5,553,788; 5,400,971; 5,395,054; D349,559; 5,351,887; 5,332,159; 5,332,156; 5,330,108; 5,303,865; 5,299,740; 5,289,974; 5,284,301; 5,284,299; 5,236,129; 5,209,405; 5,209,365; 5,178,330; 5,119,992; 5,118,080; 5,180,104; D325,241; 5,090,623; 5,074,466; 5,064,119; 5,054,687; D318,712; 5,022,590; 4,993,645; 4,934,607; 4,934,603; 4,927,079; 4,911,367; D305,453; D305,452; D305,057; D303,139; 4,844,342; 4,770,117; 4,760,962; 4,759,502; 4,747,546; 4,702,420; 4,613,082; 4,606,501; D287,266; 4,537,357; 4,529,131; 4,513,913; 4,483,483; 4,453,670; 4,437,614; 4,433,812; 4,401,268; 4,361,283; D270,368; D270,367; D270,180; D270,179; RE30,968; 4,331,298; 4,248,386; 4,214,709; 4,174,071; 4,174,070; 4,169,545; 4,165,022; D252,097; 4,133,483; 4,116,364; 4,114,564; 4,105,164; 4,081,904; 4,037,561; 4,030,857; 4,002,777; 4,001,935; 3,990,609; 3,964,683; and, 3,940,061.

It is also known in the art of vehicle fuel tank filler neck caps to provide the caps with clutches permitting the caps to be driven onto the filler necks to predetermined torques. This prevents, among other things, overtightening of the cap onto the filler neck and possible damage to the gasket that seals the cap to the filler neck to prevent the escape of fuel and fuel vapor from the fuel tank.

The disclosures of these references are hereby incorporated herein by reference. The above discussions are not intended to be a representation that a complete search of all relevant art has been made, or that no more pertinent art than that listed exists, or that the listed art is material to patentability. Nor should any such representation be inferred.

One fairly common characteristic of such spray guns is a threaded ring at the front of the spray gun for retaining on the front end of the spray gun an air cap, nozzle, or the like, necessary for the proper operation of the spray gun. A problem associated with such threaded rings is that they can be overtightened. Overtightening may make it difficult to remove the threaded ring if it should be necessary or desirable to remove the air cap, nozzle, or the like which the threaded ring is holding on the spray gun, for example, to clean it, repair it or replace it. Additionally, overtightening the air cap, nozzle, or the like can distort the shape of the air cap, nozzle, or the like. Such distortion can change the physical, spatial relationships of the various orifices provided by such an air cap, nozzle, or the like. Changing the spatial relationships of such orifices can adversely impact the quality of atomization of the coating material being dispensed from such a spray gun. This, in turn, can adversely impact the coating provided by the dispensed coating material.

DISCLOSURE OF THE INVENTION

According to the invention, a retaining ring is provided for a coating material dispenser including a nozzle for the discharge of coating material and a cap having a plurality of orifices arrayed in a spatial orientation with respect to the nozzle to supply a flow of gas or a mixture of gases to aid in dispensing of the coating material from the nozzle. The retaining ring is adapted for retaining the cap on the coating material dispenser with the plurality of orifices in the spatial orientation. The retaining ring includes first and second members. The second member is adapted for coupling to the coating material dispenser. The first member includes a first torque limiting driving member. The second member includes a second torque limiting driven member for engaging the first torque limiting driving member to limit the torque which the second member can apply to the coating material dispenser in response to manipulation of the first member.

Illustratively, the retaining ring comprises an axis about which it is to be rotated to couple the cap to, and uncouple the cap from, the coating material dispenser. The first torque limiting driving member comprises a driving face which extends generally radially and axially of the axis and a camming face which makes an acute angle with the driving face of the first torque limiting driving member.

Illustratively, the second torque limiting driven member comprises a driving face which extends generally radially and axially of the axis and a camming face which makes an acute angle with the driving face of the second torque limiting driven member. The driving faces of the first and second torque limiting driven members engage to drive the retaining ring off the coating material dispenser. The camming faces of the first and second torque limiting driven members engage to drive the retaining ring onto the coating material dispenser.

Illustratively, the first member includes a first portion providing a grip for manipulation of the first member during tightening of the retaining ring onto, and loosening of the retaining ring from, the coating material dispenser, and a second portion providing the first torque limiting driving member. Means are provided for coupling first portion nonrotatably to the second portion.

Illustratively, the retaining ring includes a plurality of first torque limiting driving members.

Illustratively, the retaining ring comprises an axis about which it is to be rotated to couple the cap to, and uncouple the cap from, the coating material dispenser. The plurality of first torque limiting driving members are equally angularly spaced around the axis.

Illustratively, the retaining ring includes a plurality of second torque limiting driven members.

Illustratively, the plurality of second torque limiting driven members are equally angularly spaced around the axis.

Illustratively, the plurality of orifices includes a central orifice and a plurality of orifices surrounding the central orifice.

Illustratively, the coating material dispenser further includes shaping orifices for directing streams of compressed gas or mixture of gases onto the coating material discharged from the nozzle. The shaping orifices are spaced forward from the central orifice and the plurality of orifices surrounding the central orifice.

Illustratively, the shaping orifices communicate with a supply gallery for the compressed gas or mixture of gases to provide compressed gas or mixture of gases for shaping the coating material discharged from the nozzle.

Illustratively, the coating material dispenser includes a valve having a somewhat frustoconically shaped portion and a complementarily configured valve seat adjacent the nozzle.

Illustratively, the coating material dispenser further includes an electrode projecting forward from the nozzle by which coating material dispensed from the nozzle becomes electrically charged.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
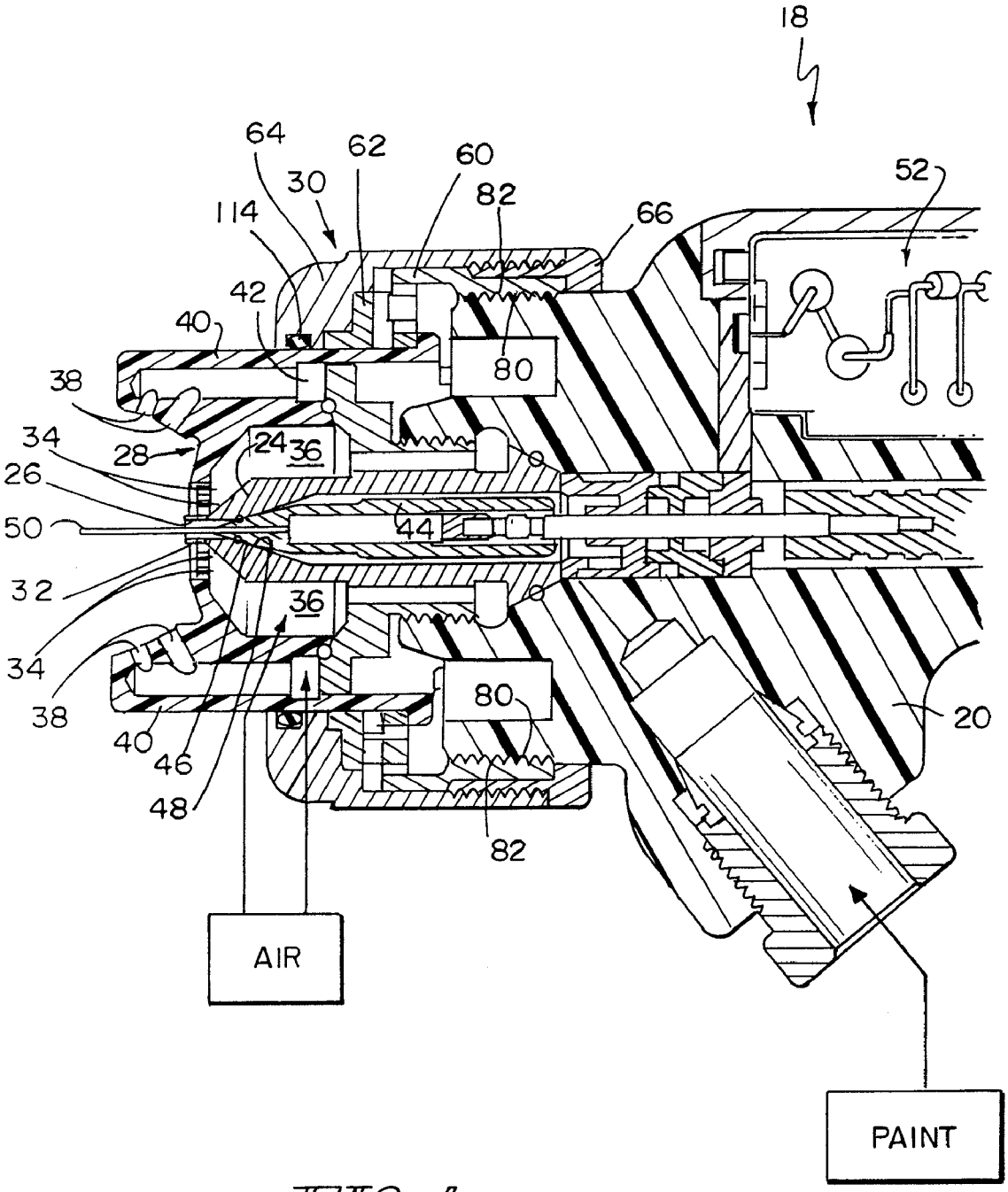
FIG. 1 illustrates a partly block and partly fragmentary sectional side elevational view of a system incorporating a ratcheting retaining ring constructed according to the invention.

Referring to FIG. 1, a spray gun 18 includes a spray gun body 20 housing a nozzle 24. Nozzle 24 is disposed at the front end of the gun body 20 to dispense fluent coating material (hereinafter sometimes paint) from a front end opening 26. An air cap 28 is attached to the front end of the gun body 20 by a retaining ring 30 constructed according to the present invention. The air cap 28 has a central atomizing air orifice 32 and a plurality of atomizing air orifices 34 surrounding the central orifice 32. These orifices communicate with a gallery 36 which is coupled to a supply of compressed air. Shaping air orifices 38 are provided on air horns 40 which extend forward from diametrically opposite sides of the air cap 28. The shaping air orifices 38 communicate with a shaping air supply gallery 42 which is also coupled to a supply of compressed air. Shaping air orifices 38 provide air for shaping a spray pattern of paint flowing from the nozzle 24 and atomized by air from atomizing air orifices 32, 34.

The spray gun includes a valve including a valve body 44 having a somewhat frustoconically shaped front end 46 which cooperates with a complementarily configured valve seat 48 formed by an inner wall of a front portion of the nozzle 24. A needle-like electrode 50 projects forward from valve body 44 and is coupled via its rearward extension through valve body 44 to a terminal of a high-magnitude potential supply 52 by which the particles of coating material become electrically charged as they leave the vicinity of nozzle 24. Spray gun body 20, nozzle 24, air cap 28, and valve body 44 illustratively are constructed from, for example, suitably chemically inert, electrically non-conductive resins or polymers, such as Delrine® or Acetron® brand acetal resin or polyetheretherketone. Electrode 50 illustratively is constructed from metal.

Figure 2:
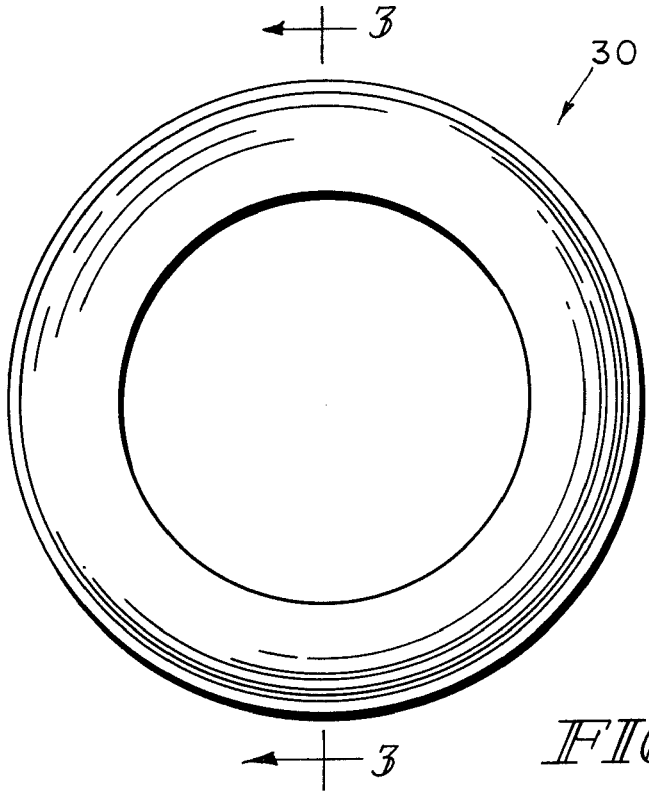
FIG. 2 illustrates an enlarged front elevational view of the ratcheting retaining ring illustrated in FIG. 1.
Figure 3:
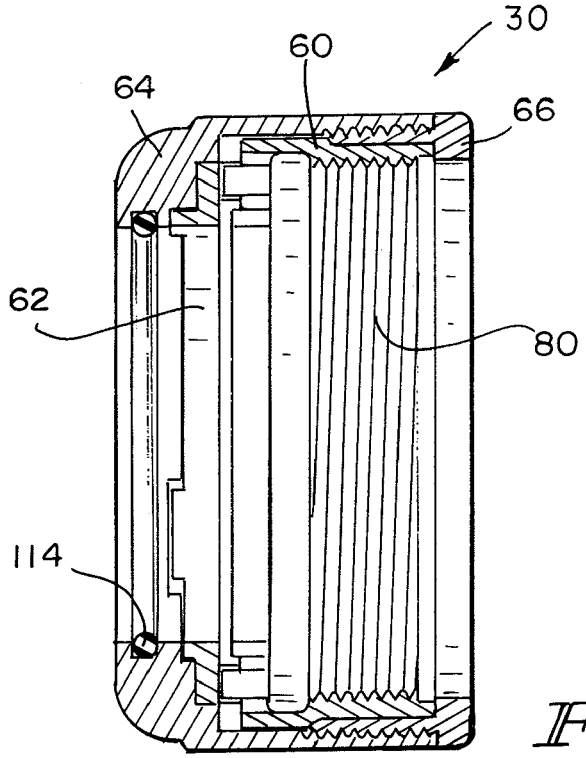
FIG. 3 illustrates a sectional side elevational view of the ratcheting retaining ring illustrated in FIGS. 1-2, taken generally along section lines 3-3 of FIG. 2.
Figure 4:
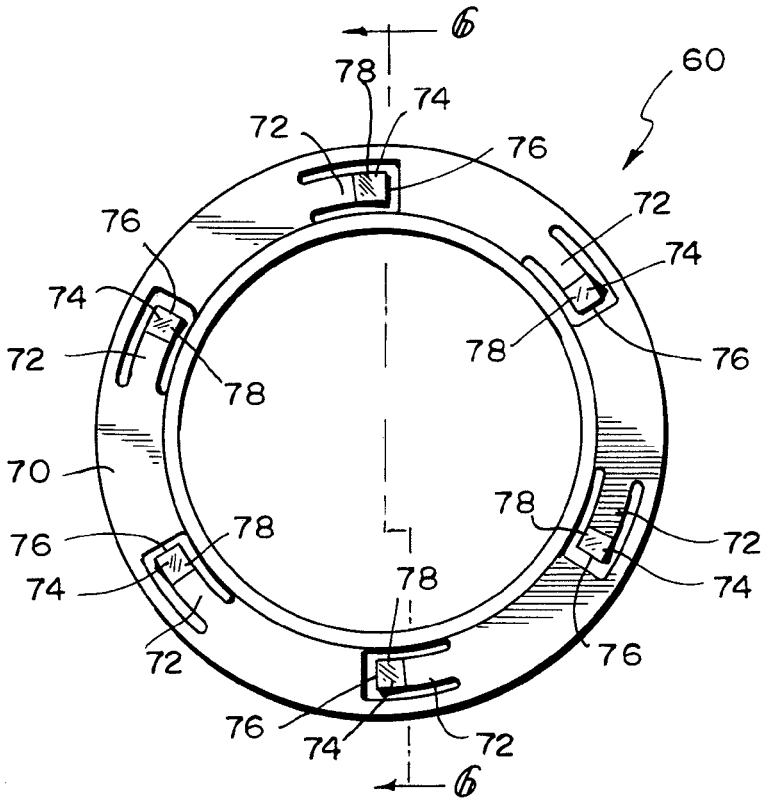
FIG. 4 illustrates a front elevational view of a detail of the ratcheting retaining ring illustrated in FIGS. 1-3.
Figure 5:
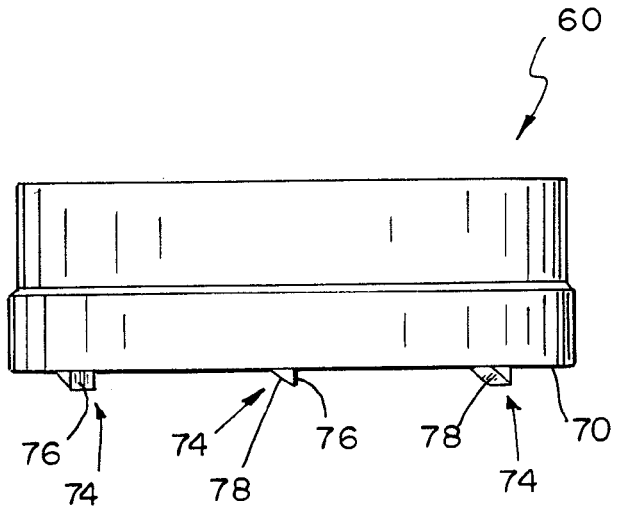
FIG. 5 illustrates a top plan view of the detail illustrated in FIG. 4.
Figure 6:
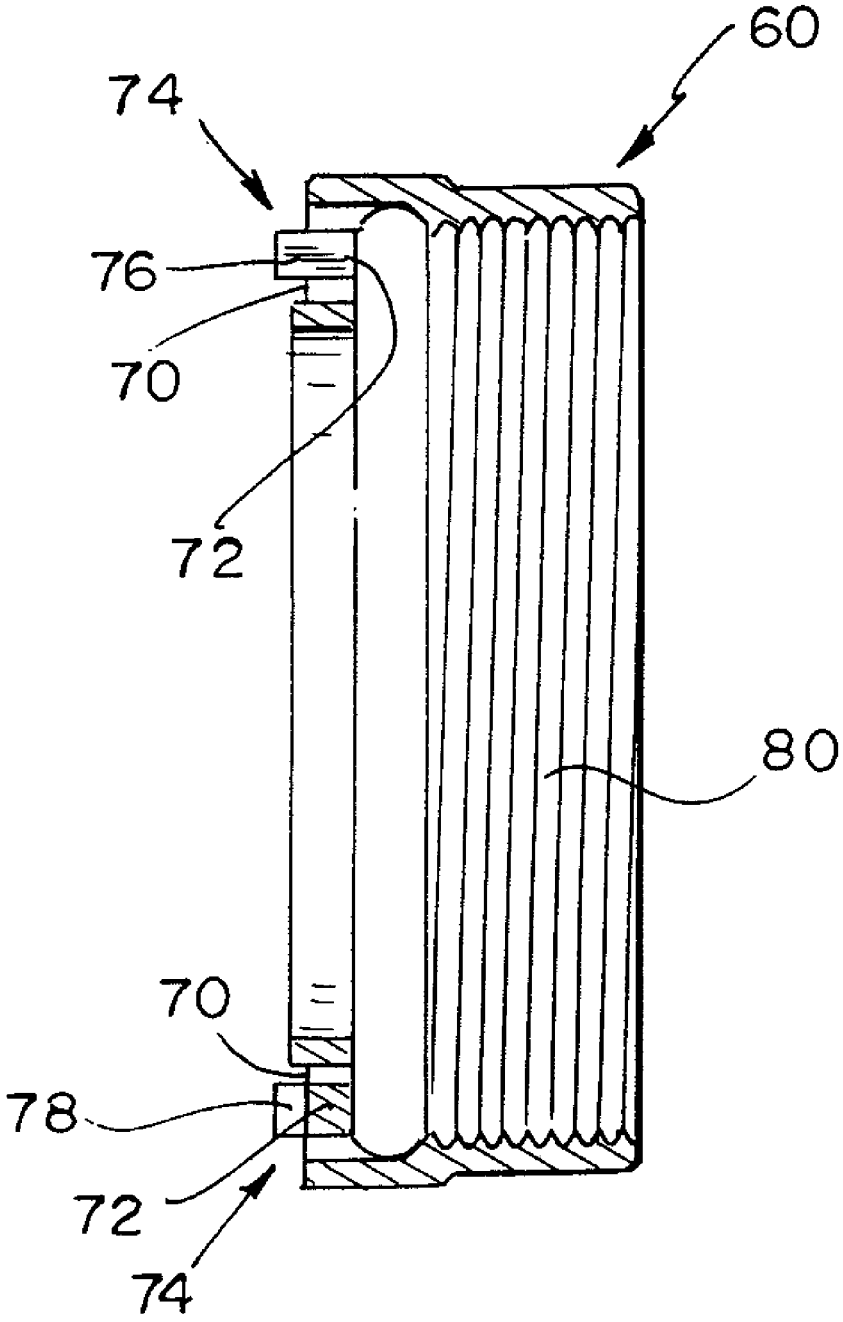
FIG. 6 illustrates a sectional side elevational view of the detail illustrated in FIGS. 4-5, taken generally along section lines 6-6 of FIG. 4.
Figure 7:
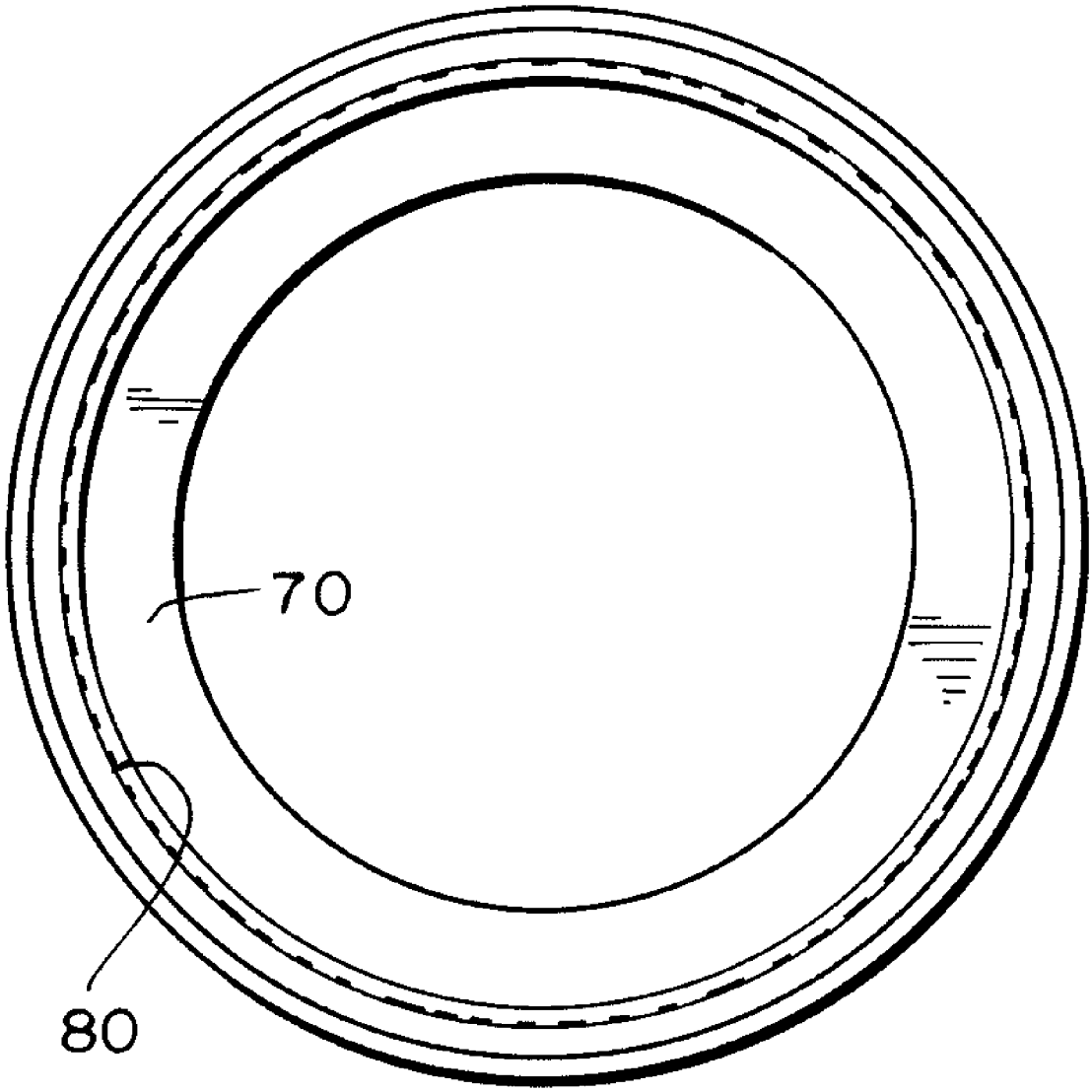
FIG. 7 illustrates a rear elevational view of the detail illustrated in FIGS. 4-6.
Figure 8:
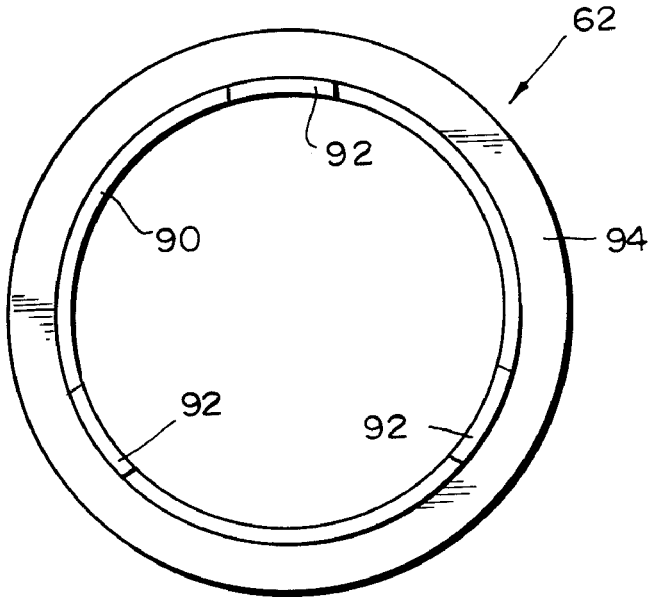
FIG. 8 illustrates a front elevational view of another detail of the ratcheting retaining ring illustrated in FIGS. 1-3.
Figure 9:
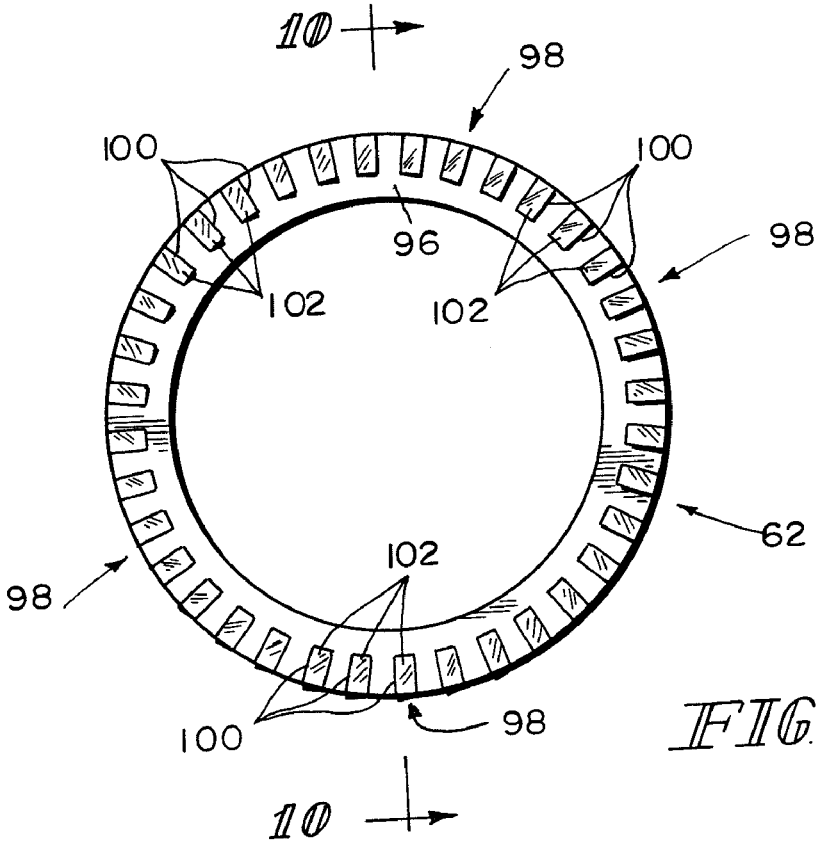
FIG. 9 illustrates a rear elevational view of the detail illustrated in FIG. 8.
Figure 10:
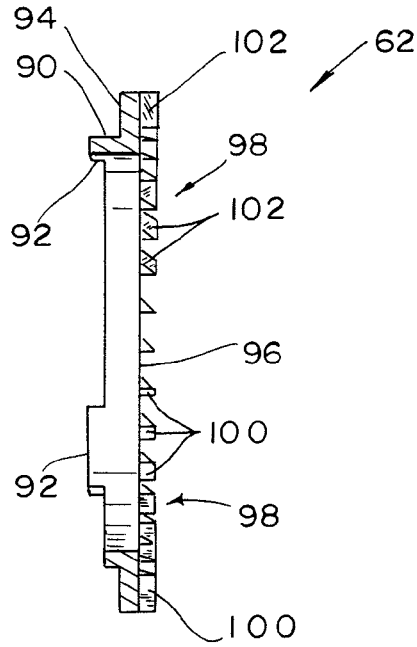
FIG. 10 illustrates a sectional side elevational view of the detail illustrated in FIGS. 8-9, taken generally along section lines 10-10 of FIG. 9.
Figure 11:
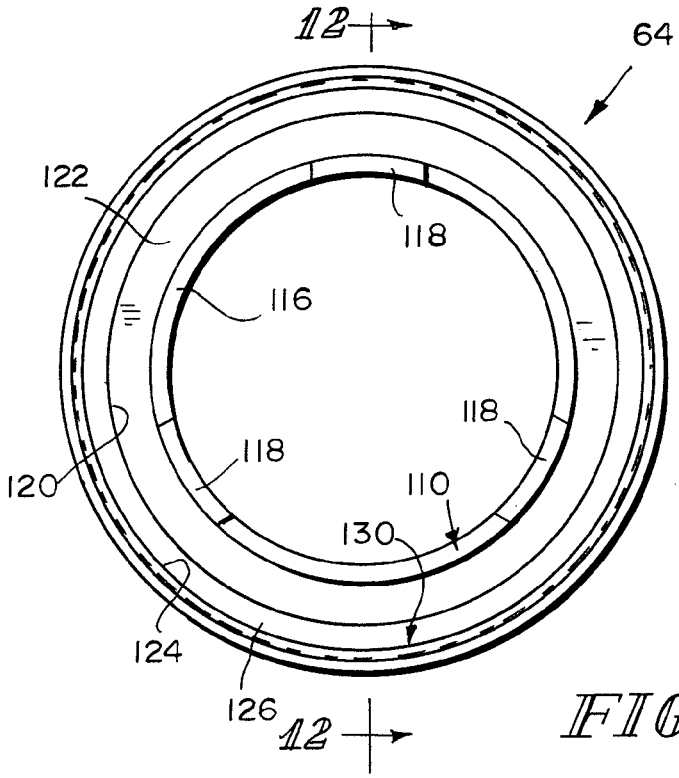
FIG. 11 illustrates a rear elevational view of another detail of the ratcheting retaining ring illustrated in FIGS. 1-3.
Figure 12:
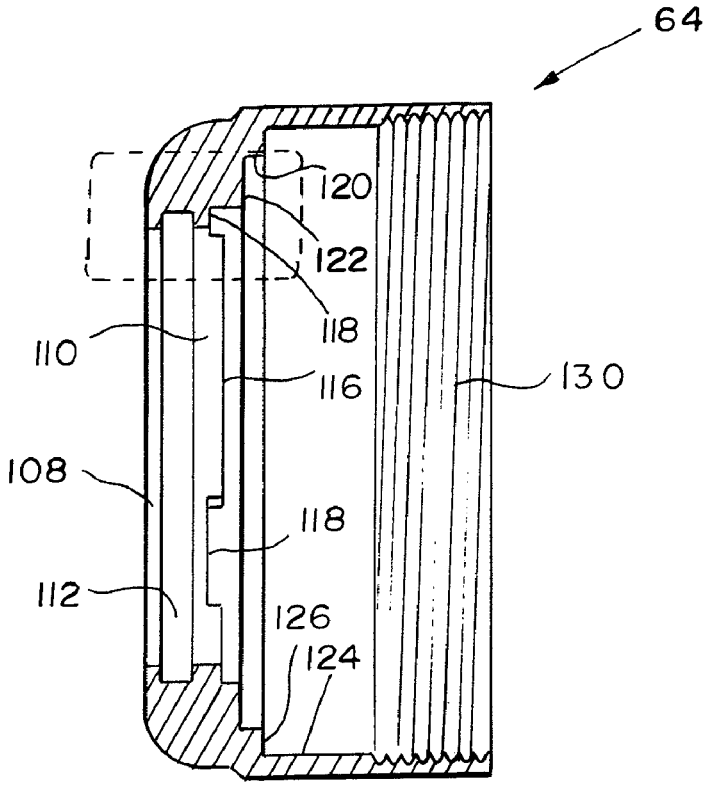
FIG. 12 illustrates a sectional side elevational view of the detail illustrated in FIG. 11, taken generally along section lines 12-12 of FIG. 11.
Figure 13:
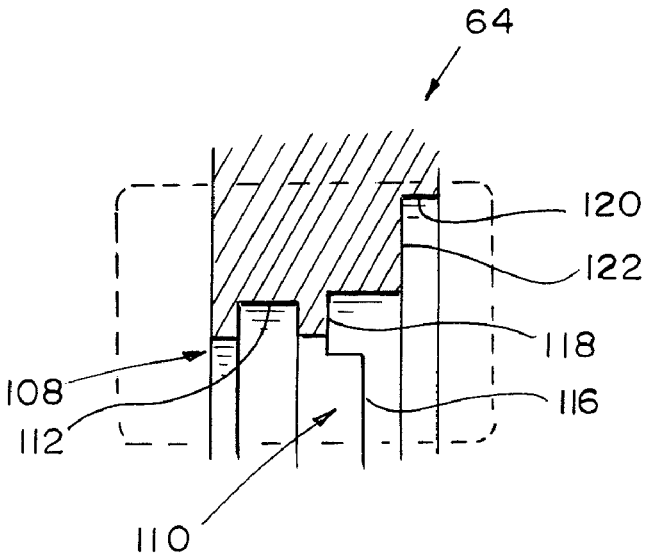
FIG. 13 illustrates an enlarged view of a detail illustrated in FIG. 12.
Figure 14:
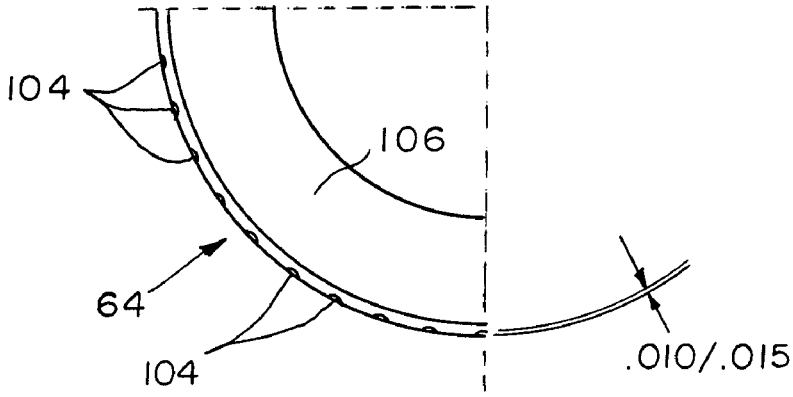
FIG. 14 illustrates a fragmentary front elevational view of the detail illustrated in FIGS. 11-12.
Figure 15:
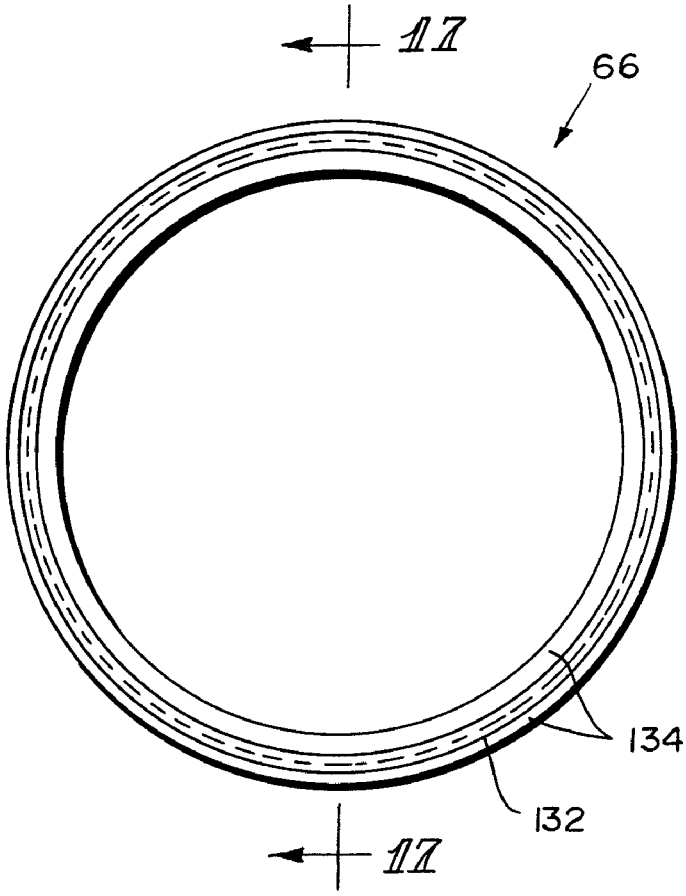
FIG. 15 illustrates a front elevational view of another detail of the ratcheting retaining ring illustrated in FIGS. 1-3.
Figure 16:
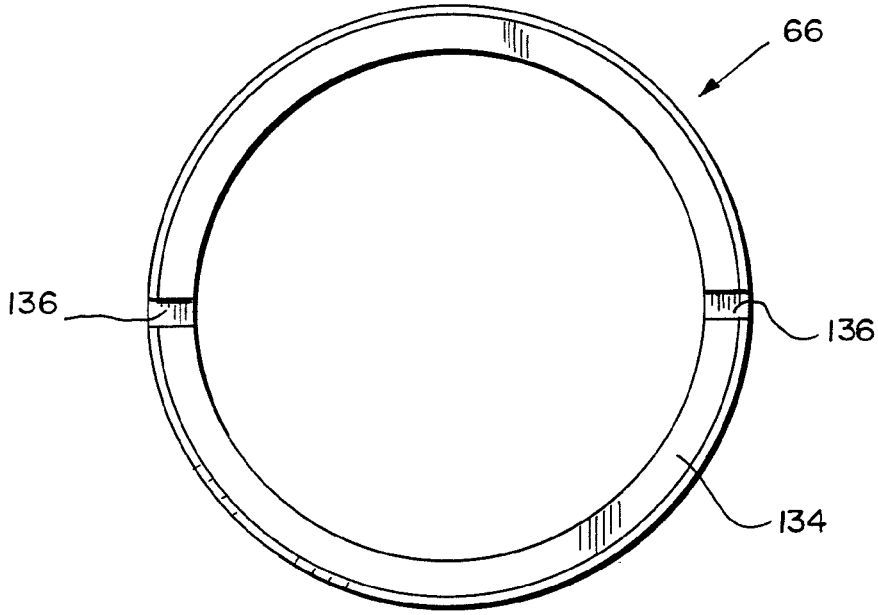
FIG. 16 illustrates a rear elevational view of the detail illustrated in FIG. 15; and, FIG. 17 illustrates a sectional side elevational view of the detail illustrated in FIGS. 15-16, taken generally along section lines 17-17 of FIG. 15.
Figure 17:
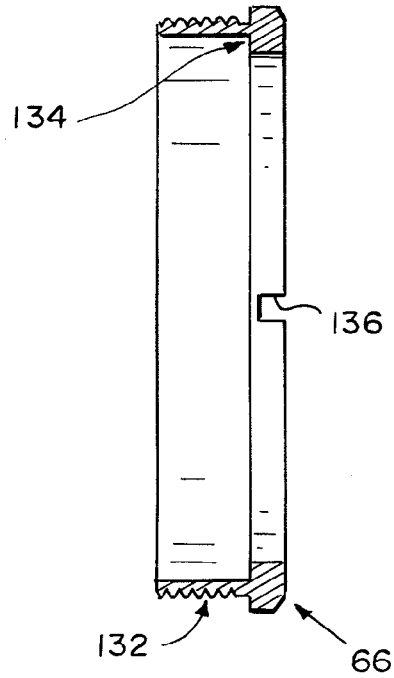

Turning now to the details of retaining ring 30, it includes a ratcheting ring or clutch ring 60, a ratcheting plate or clutch plate 62, a housing 64, and a retaining nut 66. The assembled retaining ring 30 is best illustrated in FIGS. 2-3. The details of the construction of ratcheting ring or clutch ring 60 are best illustrated in FIGS. 4-7. The details of the construction of ratcheting plate or clutch plate 62 are best illustrated in FIGS. 8-10. The details of the construction of housing 64 are best illustrated in FIGS. 11-14. Finally, the details of the construction of retaining nut 66 are best illustrated in FIGS. 15-17. Ratcheting ring or clutch ring 60, ratcheting plate or clutch plate 62, housing 64, and retaining nut 66 illustratively are constructed from Delrin® or Acetron® brand acetal resin.

Referring now to FIGS. 4-7, ratcheting ring or clutch ring 60 includes a front clutch face 70 including fingers 72 which are capable, owing to the material from which ratcheting ring or clutch ring 60 is constructed, of resiliently flexing axially of retaining ring 30 inwardly into face 70 and returning to their unflexed orientations. A pawl 74 is provided at the end of each of fingers 72. Each pawl 74 has a driving face 76 which extends generally radially and axially of ratcheting ring or clutch ring 60. Each pawl 74 also includes a camming face 78 which makes with its respective driving face 76 an acute angle of, for example, 45°. The body of ratcheting ring or clutch ring 60 rearward from front clutch face 70 is generally right circular cylindrical and is internally threaded as illustrated at 80 to engage threads 82 provided on the outside of the front of spray gun body 20.

Referring now to FIGS. 8-10, ratcheting plate or clutch plate 62 includes a forwardly extending, generally right circular cylindrical portion 90 from which a number, illustratively three, of equally angularly spaced tabs 92 extend forward. At the rearward end of the generally right circular cylindrical portion 90 is a radially outwardly extending flange 94, from the rear face 96 of which project a number, illustratively thirty-six, of equally angularly spaced pawls 98. Each pawl 98 has a driving face 100 which extends generally radially and axially of ratcheting plate or clutch plate 62. Each pawl 98 also includes a camming face 102 which makes with its respective driving face 100 an acute angle of, for example, 45°.

Referring now to FIGS. 11-14, housing 64 includes a slightly scalloped 104 outer surface 106 to promote gripping to facilitate loosening and tightening of the retaining ring 30. Housing 64 also includes a forward, generally radially extending first lip 108 and a rearwardly spaced, generally radially and axially extending second lip 110. Lips 108, 110 define between them a groove 112 for receiving an O-ring 114 for sealing against a front surface of the air cap 28. O-ring 114 illustratively is a fluorinated ethylene propylene (FEP) encapsulated Viton® FKM fluoroelastomer. The rearward, generally radially extending face 116 of lip 110 includes notches 118 in the same locations as the tabs 92 on ratcheting plate or clutch plate 62 to receive the tabs 92 in the assembled retaining ring 30. Rearwardly from second lip 110, housing 64 includes a somewhat larger diameter right circular cylindrical region 120 bounded by a surface 122, then a somewhat larger diameter right circular cylindrical region 124 bounded by a surface 126. The rearwardmost portion of region 124 is internally threaded as indicated at 130.

Referring now to FIGS. 15-17, retaining nut 66 includes a forward, generally right circular cylindrical portion 132, externally threaded to engage the threads 130 of housing 64 in the assembled retaining ring 30. Rearwardly from portion 132, retaining nut 66 includes a flange 134, the outside dimension of which is generally the same as the outside dimension of housing 64, thereby providing a reasonably smooth outside surface to the assembled retaining ring 30. The inside dimension of flange 134 is small enough to rotatably capture ratcheting ring or clutch ring 60 in the assembled retaining ring 30. The back side of flange 134 is provided with a pair of diametrically spaced notches 136 for inserting prongs of a wrench to tighten retaining nut 66 into housing 64 during assembly of the retaining ring 30.

In assembly, first ratcheting plate or clutch plate 62 is inserted into housing 64 and tabs 92 into engagement in notches 118 and pawls 98 pointing rearwardly. This fixes ratcheting plate or clutch plate 62 against rotation relative to housing 64. Then ratcheting ring or clutch ring 60 is inserted into housing 64 with pawls 74 pointing forwardly, and pawls 74 are brought into engagement with selected pawls 98 on ratcheting plate or clutch plate 62. The fingers 72 flex at the desired torque to permit relative movement between the camming faces 78 and 102, respectively, of pawls 74 and 98, respectively, to provide the torque limiting tightening feature of retaining ring 30 which reduces the likelihood of overtightening of retaining ring 30 and the consequent distortion of the spatial relationships of the various orifices in the nozzle 24 and air cap 28, or other damage to the front end of spray gun 18. Finally, threads 130 and 132 are engaged and threaded tight to complete the assembly of retaining ring 30. The driving faces 76 and 100 of pawls 74 and 98, respectively, engage when the housing 64 is turned in a direction to disengage retaining ring 30 from threads 82 on spray gun 18.

The retaining ring 30 that limits the amount of torque that may be applied to ratcheting ring or clutch ring 60. This, in turn, limits the force that may be applied to the air cap 28 and/or nozzle 24 by the retaining ring 30. This reduces the likelihood of deformation of the air cap 28 and/or nozzle 24, such as would alter the spatial relationships of the various orifices 26, 32, 34, 38 and the like of the air cap 28 and/or nozzle 24 that might otherwise adversely impact the quality of atomization of the coating material being dispensed from such a spray gun 18. The ratcheting ring or clutch ring 60 and ratcheting plate or clutch plate 62 implement a torque override device that permits the ratcheting ring or clutch ring 60 to slip once the override torque of the ratcheting ring or clutch ring 60 and ratcheting plate or clutch plate 62 is reached when the housing 64/ratcheting plate or clutch plate 62 assembly is turned in a direction to tighten the retaining ring 30 on the front of spray gun 18. The ratcheting ring or clutch ring 60 does not slip when turned in a direction to loosen the retaining ring 30 on the front of spray gun 18.

What is claimed is:

1. A retaining ring for a coating material dispenser including a nozzle for the discharge of coating material, a cap having a plurality of orifices arrayed in a spatial orientation with respect to the nozzle to supply a flow of gas or a mixture of gases to aid in dispensing of the coating material from the nozzle, the retaining ring including first and second members, the second member adapted for coupling to the coating material dispenser, the first member including at least one first torque limiting driving member, and the second member including at least one second torque limiting driven member for engaging the first torque limiting driving member to limit the torque which the second member can apply to the coating material dispenser in response to manipulation of the first member, wherein the retaining ring for retaining the cap on the coating material dispenser with the plurality of orifices in the spatial orientation.

2. The retaining ring of claim 1 comprising an axis about which it is to be rotated to couple the cap to, and uncouple the cap from, the coating material dispenser, the first torque limiting driving member comprises a driving face which extends generally radially and axially of the axis and a camming face which makes an acute angle with the driving face of the first torque limiting driving member.

3. The retaining ring of claim 2 wherein the second torque limiting driven member comprises a driving face which extends generally radially and axially of the axis and a camming face which makes an acute angle with the driving face of the second torque limiting driven member, the driving faces of the first torque limiting driving member and second torque limiting driven member engaging to drive the retaining ring off the coating material dispenser, and the camming faces of the first torque limiting driving member and second torque limiting driven member engaging to drive the retaining ring onto the coating material dispenser.

4. The retaining ring of claim 1 wherein the first member includes a first portion providing a grip for manipulation of the first member during tightening of the retaining ring onto, and loosening of the retaining ring from, the coating material dispenser, a second portion providing the first torque limiting driving member, and means for coupling first portion nonrotatably to the second portion.

5. The retaining ring of claim 1 including a plurality of first torque limiting driving members.

6. The retaining ring of claim 5 comprising an axis about which it is to be rotated to couple the cap to, and uncouple the cap from, the coating material dispenser, the plurality of first torque limiting driving members being equally angularly spaced around the axis.

7. The retaining ring of claim 1 including a plurality of second torque limiting driven members.

8. The retaining ring of claim 7 comprising an axis about which it is to be rotated to couple the cap to, and uncouple the cap from, the coating material dispenser, the plurality of second torque limiting driven members being equally angularly spaced around the axis.

9. A coating material dispenser including a nozzle for the discharge of coating material, a cap having a plurality of orifices arrayed in a spatial orientation with respect to the nozzle to supply a flow of gas or a mixture of gases to aid in dispensing of the coating material from the nozzle, a retaining ring for retaining the cap on the coating material dispenser with the plurality of orifices in the spatial orientation, the retaining ring including a first member, a second member adapted for coupling to the coating material dispenser, the first member including at least one first torque limiting driving member, and the second member including at least one second torque limiting driven member for engaging the first torque limiting driving member to limit the torque which the second member can apply to the coating material dispenser in response to manipulation of the first member.

10. The coating material dispenser of claim 9 wherein the retaining ring comprises an axis about which it is to be rotated to couple the cap to, and uncouple the cap from, the coating material dispenser, the first torque limiting driving member comprises a driving face which extends generally radially and axially of the axis and a camming face which makes an acute angle with the driving face of the first torque limiting driving member.

11. The coating material dispenser of claim 10 wherein the second torque limiting driven member comprises a driving face which extends generally radially and axially of the axis and a camming face which makes an acute angle with the driving face of the second torque limiting driven member, the driving faces of the first torque limiting driving member and second torque limiting driven member engaging to drive the retaining ring off the coating material dispenser, and the camming faces of the first torque limiting driving member and second torque limiting driven member engaging to drive the retaining ring onto the coating material dispenser.

12. The coating material dispenser of claim 9 wherein the first member includes a first portion providing a grip for manipulation of the first member during tightening and loosening of the retaining ring, a second portion providing the first torque limiting driving member, and means for coupling first portion nonrotatably to the second portion.

13. The coating material dispenser of claim 9 wherein the retaining ring comprises a plurality of first torque limiting driving members.

14. The coating material dispenser of claim 13 wherein the retaining ring comprises an axis about which it is to be rotated to couple the cap to, and uncouple the cap from, the coating material dispenser, the plurality of first torque limiting driving members being equally angularly spaced around the axis.

15. The coating material dispenser of claim 9 wherein the retaining ring comprises a plurality of second torque limiting driven members.

16. The coating material dispenser of claim 15 comprising an axis about which it is to be rotated to couple the cap to, and uncouple the cap from, the coating material dispenser, the plurality of second torque limiting driven members being equally angularly spaced around the axis.

17. The coating material dispenser of claim 9 wherein the plurality of orifices includes a central orifice and a plurality of orifices surrounding the central orifice.

18. The coating material dispenser of claim 17 further including shaping orifices for directing streams of compressed gas or mixture of gases onto the coating material discharged from the nozzle, the shaping orifices being spaced forward from the central orifice and the plurality of orifices surrounding the central orifice.

19. The coating material dispenser of claim 18 wherein the shaping orifices communicate with a supply gallery for the compressed gas or mixture of gases to provide compressed gas or mixture of gases for shaping the coating material discharged from the nozzle.

20. The coating material dispenser of claim 9 including a valve having a somewhat frustoconically shaped portion and a complementarily configured valve seat adjacent the nozzle.

21. The coating material dispenser of claim 9 further including an electrode projecting forward from the nozzle by which coating material dispensed from the nozzle becomes electrically charged.

* * * * *